US005381212A

United States Patent [19]

Noguchi et al.

[11] Patent Number: 5,381,212

[45] Date of Patent: Jan. 10, 1995

[54] PHOTORECEPTOR FOR ELECTROPHOTOGRAPHY

[75] Inventors: Teruhiko Noguchi, Sakai; Hiroshi Kinashi, Tsuzuki; Jitsuo Masuda, Yamatotakada; Katsushi Inoue, Yamatokoriyama; Tatsuo Tanaka, Matsumoto; Kunio Otsuki, Higashichikuma; Kazuya Adachi, Matsumoto, all of Japan

[73] Assignees: Sharp Kabushiki Kaisha; Fuji Electric Co., Ltd., both of Japan

[21] Appl. No.: 88,874

[22] Filed: Jul. 8, 1993

[30] Foreign Application Priority Data

Jul. 13, 1992 [JP] Japan ..... 4-185515

[51] Int. Cl.[6] ..... G03G 21/00

[52] U.S. Cl. ..... 355/211; 355/212

[58] Field of Search ..... 355/211, 212, 200; 346/160, 160.1; 430/56

[56] References Cited

U.S. PATENT DOCUMENTS

| | | | |
|---|---|---|---|
| 4,795,906 | 1/1989 | Adams et al. | 250/341 |
| 5,198,852 | 3/1993 | Mikami | 355/211 |
| 5,296,895 | 3/1994 | Naito | 355/208 |

FOREIGN PATENT DOCUMENTS

| | | | |
|---|---|---|---|
| 0139448 | 5/1985 | European Pat. Off. . | |
| 285640 | 12/1990 | Germany . | |
| 0044450 | 3/1983 | Japan | 355/211 |
| 58-185868 | 12/1983 | Japan . | |
| 60-101574 | 6/1985 | Japan . | |
| 60-154278 | 8/1985 | Japan . | |
| 60-260067 | 12/1985 | Japan . | |
| 62-87978 | 4/1987 | Japan . | |
| 0177877 | 8/1991 | Japan | 355/211 |
| 0000458 | 1/1992 | Japan | 355/211 |

*Primary Examiner*—Robert B. Beatty

*Attorney, Agent, or Firm*—David G. Conlin; Peter F. Corless

[57] ABSTRACT

A photoreceptor having a marking area whose optical reflection property differs from that of a non-marking area is formed in a portion of a surface of an electrically conductive substrate. The average line of a vertical section of the non-marking area cut across the border line with the marking area is $M_0$ and the average line of a vertical section of the marking area cut across the border line is $N_0$ and that straight lines touching the average lines $M_0$ and $N_0$ at the intersection of $M_0$ and $N_0$ are tangent lines $M_1$ and $N_1$, respectively, the acute angle $\theta$ between $M_1$ and $N_1$ is within the range of $0° \leqq \theta \leqq 30°$. Setting the angle $\theta$ within this range enables a photoconductive layer of a uniform characteristic to be laminated on the electrically conductive substrate even when the marking area is formed on the surface of the substrate. With this arrangement, since information for optimizing the image quality of copies is obtained from the same location of a photoreceptor drum with reference to the marking area, a photoreceptor for electrophotography always produces copies of stable image quality.

10 Claims, 5 Drawing Sheets

PHOTORECEPTOR FOR ELECTROPHOTOGRAPHY

FIELD OF THE INVENTION

The present invention relates to a photoreceptor having an electrically conductive substrate and a photoconductive layer for use in electrophotography, and more particularly relates to a photoreceptor capable of optimizing the image quality of copies.

BACKGROUND OF THE INVENTION

An electrophotographic process usually proceeds in sequence as programmed: pressing a copying start key; driving a photoreceptor; charging the photoreceptor; forming a latent image by exposure; developing the image; supplying paper; transferring the image to the paper; fusing the image; cleaning the photoreceptor surface; and removing residual electrical potential from the photoreceptor. Through such an electrophotographic process a copy of an original image is produced.

In recent years, in order to meet a market demand for high quality copies, factors of the electrophotographic process such as the charged potential of the photoreceptor, the lamp voltage of an optical system and the toner density are controlled so as to obtain solid black and half-tone images of a uniform density. Namely, an electrostatic latent image or a toner image is formed on a portion of the photoreceptor surface and the current information about the surface potential at the portion or the density of the toner image is supplied to a control circuit. Control information for producing good images is thus derived from the current information.

More specifically, the charged potential of the photoreceptor and the surface potential after exposure are measured with a surface electrometer. The resulting values are respectively compared with a reference potential. According to the difference an applied voltage of a charger and the lamp voltage of the light source are controlled. In an alternative method, a patch of a uniform density is placed in a portion of a document platen, the toner image of the patch is formed in a portion of the photoreceptor and the density of the toner image is measured with an optical sensor. The ratio of toner to developer is controlled according to the result of the measurement. Such a control is performed before transferring the toner image to copy paper.

With a conventional structure, however, an electrostatic latent image or a toner image of the patch can not always be formed in a predetermined portion on the photoreceptor surface. The reason for this is as follows.

The electrostatic latent image or the toner image of the patch is formed on the photoreceptor surface by an exposure operation or a development operation after exposure. Exposure or development of the image is performed when a predetermined time elapses after a copying start instruction is input through, for example, the copying start key. The position of the photoreceptor at the time the copying operation starts is not determined. As the position of the photoreceptor changes arbitrarily, the electrostatic latent image or the toner image of the patch is formed in various portions of the photoreceptor surface.

Thus, even when a patch of a uniform density is used, there are relatively wide fluctuations in the values obtained from the electrostatic latent image or the toner image of the patch are not uniform due to the configuration (circularity) and mechanical variations of the photoreceptor such as rotational displacement, or variations in the photoconductivity at different portions of the photoreceptor surface. Namely, since the control information for producing good quality images varies every copying operation, copies of optimum image quality can not be obtained constantly.

SUMMARY OF THE INVENTION

It is an object of the present invention to provide a photoreceptor for electrophotography, having a marking area to be used as reference location in the formation of an electrostatic latent image or a toner image of a patch on a predetermined location of the photoreceptor.

It is another object to provide a photoreceptor for electrophotography, having a marking area which is formed so as not to break a uniform characteristic of a photoconductive layer by specifying the configurations of the marking area and a non-marking area at the border therebetween.

In order to achieve the above object, a photoreceptor for electrophotography of the present invention includes an electrically conductive substrate including a first surface having a first optical reflection property, and a second surface having a second optical reflection property which differs from the first optical reflection property, the second surface being formed in a portion of the first surface, and a photoconductive layer formed on the electrically conductive substrate. Defining that the average line of a vertical section of the first surface cut across a border line between the first and second surfaces is $M_0$ and the average line of a vertical section of the second surface cut across the border line is $N_0$ and that straight lines touching the average lines $M_0$ and $N_0$ at the intersection of the average lines $M_0$ and $N_0$ are tangent lines $M_1$ and $N_1$, respectively, the acute angle $\theta$ between the tangent lines $M_1$ and $N_1$ is within the range of $0° \leqq \theta \leqq 30°$.

With this arrangement, by using the second surface as a reference location, it is possible to form an electrostatic latent image or a visible image of a patch of a reference density on a predetermined location of the photoreceptor. It is thus possible to obtain information for optimizing the image quality of copies from the electrostatic latent image or the visible image of the patch.

Here, the photoconductive layer must be formed on the electrically conductive substrate so that its characteristic is not disturbed by the second surface. Therefore, the angle between the first and second surfaces at the border need to meet a predetermined requirement so as to ensure smoothness. When the first and second surfaces are not level with each other, for example, the border appears as an irregular white line in half-tone images.

To prevent such a problem, the relationship between the vertical sections of the first and second surfaces and image quality were analyzed by varying the connection between the average line $M_0$ and the average line $N_0$. The results show that, when the average lines $M_0$ and $N_0$ are connected while having the angle $\theta$ within the range of $0° \leqq \theta \leqq 30°$, a photoconductive layer of a uniform characteristic is formed on the electrically conductive substrate.

Moreover, if the level of the first surface and that of the second surface vary partially or entirely at the border, faulty images including blank and black dots are produced or the appearance of the photoconductive layer is spoiled. Such a problem is solved by controlling a difference in level between two arbitrary points on the average lines $M_0$ and $N_0$ to be not greater than 2 μm when processing the second surface.

Thus, the photoreceptor of electrophotography of this invention is capable of optimizing the image quality of copies.

For a fuller understanding of the nature and advantages of the invention, reference should be made to the ensuing detailed description taken in conjunction with the accompanying drawings.

DESCRIPTION OF THE EMBODIMENTS

The following description discusses one embodiment of the present invention with reference to FIGS. 1 through 8.

Figure 1A:
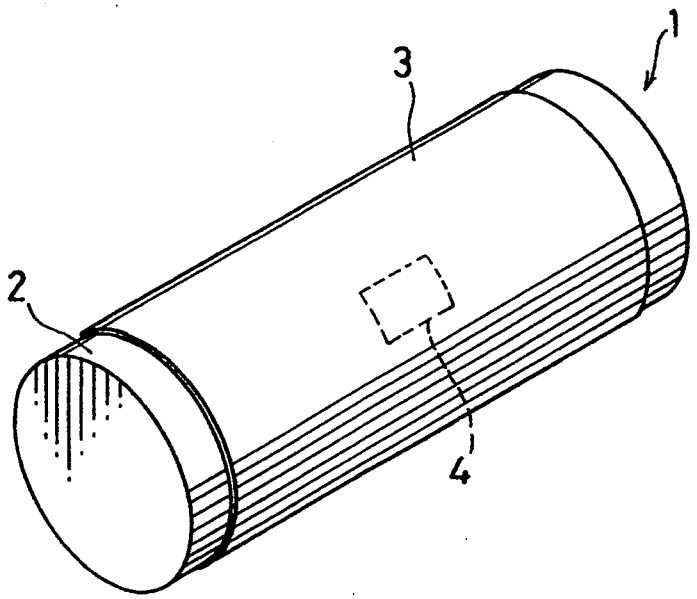
FIG. 1(*a*) is a perspective view of a photoreceptor for electrophotography according to the present invention, and FIG. 1(*b*) is an explanatory view illustrating profile curves of the vertical sections of portions of an electrically conductive substrate in the vicinity of an edge of a marking area formed in the substrate and the results of the analysis of the profile curves.
Figure 1B:
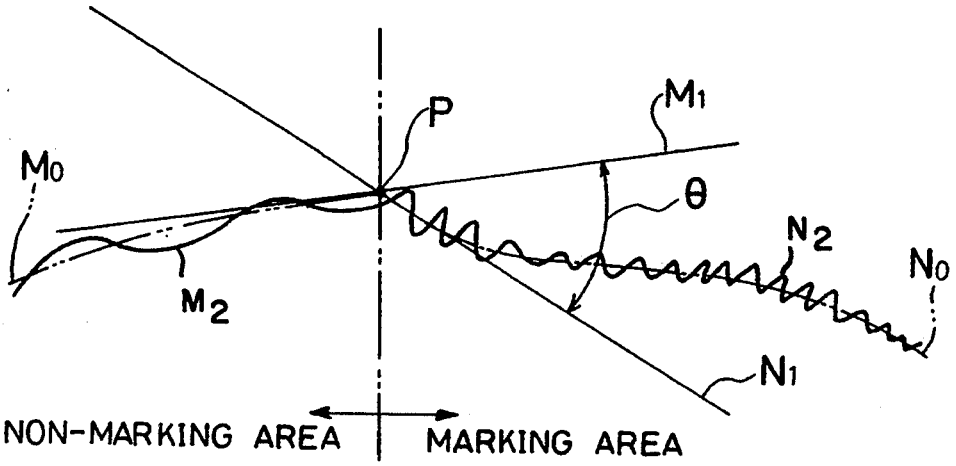

As illustrated in FIG. 1(*a*), a photoreceptor drum 1 on which an electrostatic latent image and visible image of the original image is formed has a diameter in the range of 30 mm to 242 mm and includes an electrically conductive substrate 2 and a photoconductive layer 3. The substrate 2 is formed by an electrically conductive material such as aluminum. The photoconductive layer 3 is formed by selenium and an organic semiconductor material for example. The substrate 2 is precisely processed to have a surface roughness of $R_{max}=0.2$ μm to 1.0 μm. Moreover, a portion of the substrate 2 is processed into a marking area 4 having an optical reflection property which is different from that of other portions of the substrate 2. For example, the marking area 4 is processed to have a rougher surface. The marking area 4 corresponds to "the second surface" of the present invention. The shape of the marking area 4 is freely determined, and it may have an angular, oval, circular, or undefined shape. The photoconductive layer 3 is laminated onto the substrate 2 including the marking area 4 by vapor deposition.

Figure 8:
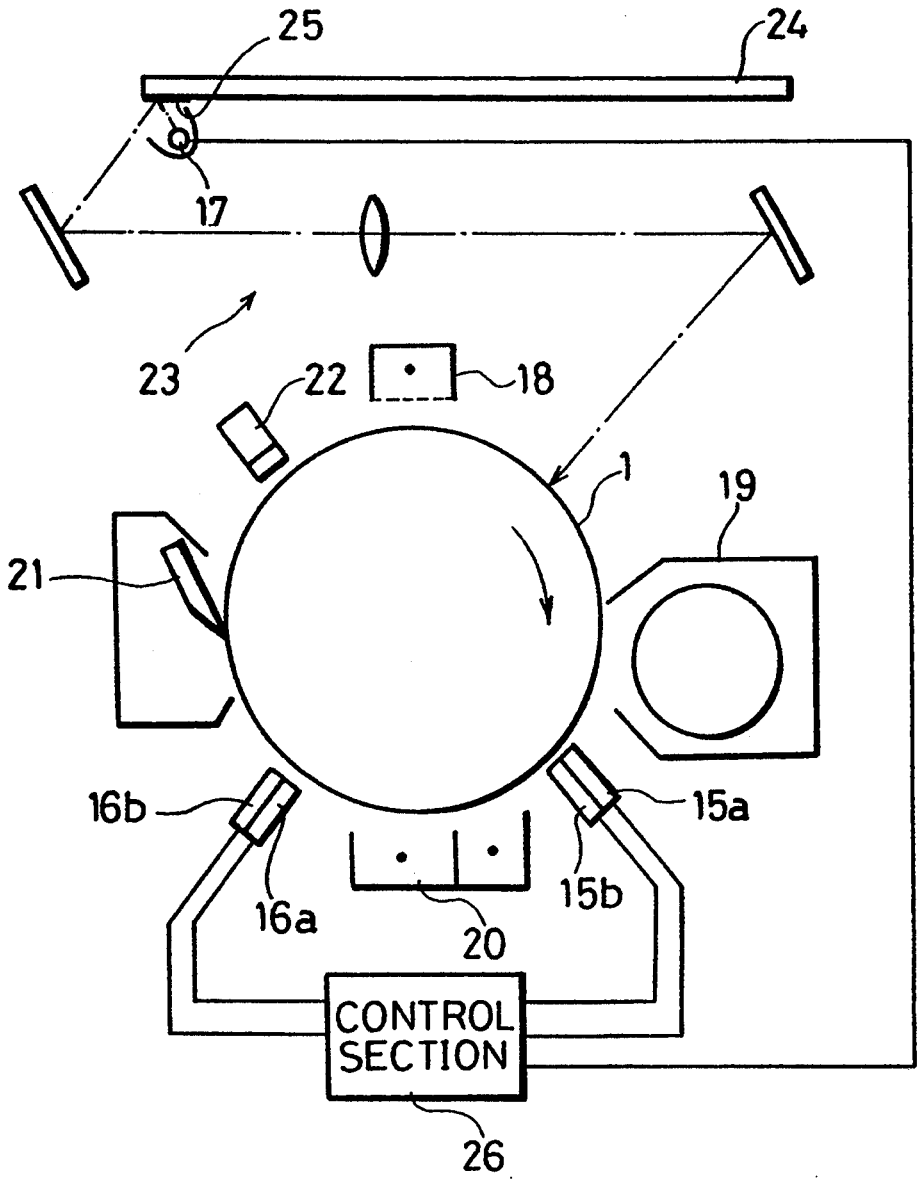
FIG. 8 is an explanatory view schematically illustrating an internal structure of a copying machine incorporating the photoreceptor for electrophotography of the present invention.

The photoreceptor drum 1 having such a structure is incorporated into an actual copying machine. FIG. 8 schematically illustrates essential components of the copying machine.

A patch 25 of a uniform density is formed in a portion of a document platen 24 to face an exposure lamp 17. Although the patch 25 is formed in any portion located outside the front edge (corresponding to leading end of a document), rear edge or side edges of a document area of the document platen 24, it is desirable to form the patch 25 in a portion located near the center of the front edge of the document area but outside the front edge in order to accurately control the electrophotographic process.

Disposed under the document platen 24 are the photoreceptor drum 1, and an optical system 23 between the document platen 24 and the photoreceptor drum 1 for directing reflected light from the document to a portion of the photoreceptor drum 1 to be exposed. For instance, the following members are disposed around the photoreceptor drum 1 from the portion to be exposed along a rotating direction of the photoreceptor drum 1 shown by an arrow in FIG. 8.

(1) Developing device 19 for developing an electrostatic latent image formed on the exposed portion.

(2) Photocoupler having a light emitting section 15*a* and a light receiving section 15*b* for detecting the marking area 4.

(3) Transfer and separation charger 20 for transferring a visible image on the photoreceptor drum 1 to copy paper and separating the copy paper from the photoreceptor drum 1.

(4) Photocoupler having a light emitting section 16*a* and a light receiving section 16*b* for detecting the density of the visible image of the patch 25.

(5) Cleaning blade 21 for collecting developer remaining on the photoreceptor drum 1.

(6) Discharge lamp 22 for removing charges remaining on the photoreceptor drum 1.

(7) Charger 18 for uniformly charging the photoreceptor drum 1.

The controlled sections such as the light emitting sections 15*a* and 16*a*, the light receiving sections 15*b* and 16*b*, and the exposure lamp 17 are respectively connected to a control section 26. It is possible to control a voltage to be applied to a corona discharge wire of the charger 18 or a grid electrode and a development bias voltage instead of controlling the lamp voltage.

In an actual copying operation, when an instruction to make a copy is given, the light emitting section 15*a* projects light onto the photoreceptor drum 1 rotating at a predetermined speed. The light receiving section 15*b* informs the control section 26 of a reference location of the photoreceptor drum 1 by transmitting to the control section 26 an output signal which lowers at the marking area 4.

After receiving the information of the reference location, the control section 26 executes a series of operations for making a copy from the patch 25. The series of operations starts with charging by the charger 18. The visible image of the patch 25 is formed on the photoreceptor drum 1 when a predetermined time has elapsed after the detection of the reference location. Namely, the visible image is always formed in the same portion on the photoreceptor drum 1.

Then, the light emitting section 16*a* starts projecting light, and the light receiving section 16*b* transmits to the control section 26 an output corresponding to the density of the visible image of the patch 25. The control section 26 compares the output of the light receiving section 16*b* with the reference electric potential and, for example, controls the lamp voltage to be applied to the exposure lamp 17 to have an optimum value.

By making the detection of the marking area 4 a reference point, the visible image of the patch 25 with the predetermined density is always formed in the same location on the photoreceptor drum 1. Moreover, copying of the document is performed after optimizing the factors of the copying process based on the density of the visible image of the patch 25. Therefore, solid-black and half-tone images always have uniform density, achieving significantly stabilized image quality.

Basically, it is ideal to copy the patch 25 and optimize the process factors every time a copy of the original document is produced. However, this causes a lowering of the speed of copying, and an increase in the consumption of toner in making a copy of the patch 25. Therefore, practically, the optimization of the process factors is executed:

(a) after the main switch is turned on;
(b) after a predetermined number of copies are produced; or
(c) when the copying machine has not been used for a predetermined time.

It is not necessary to set the time for optimizing the copying process and the process factors just after one of the above-mentioned stages (a)–(c). Namely, it is also possible to perform optimization after a combination of the stages.

In this embodiment, the photocoupler formed by the light emitting section 15*a* and the light receiving section 15*b* and the photocoupler formed by the light emitting section 16*a* and the light receiving section 16*b* are separately provided. However, it is possible to detect both the density of the marking area 4 and that of the visible image of the patch 25 with one of the photocouplers.

When there is a difference in surface level between the marking area 4 and other portion (hereinafter referred to as a non-marking area which corresponds to "the first surface" of the present invention) in the surface of the substrate 2, the substrate surface becomes uneven. This also creates unevenness in the corresponding portion of the surface of the photoconductive layer 3 which is laminated on the substrate 2. This unevenness causes imperfect images including blank and black dots, or defective appearance of the photoconductive layer 3. The unevenness implies a partial difference in level between the marking area 4 and the non-marking area, and a difference in level between the average lines of the marking area 4 and the non-marking area, to be described later. In the case when the substrate 2 is formed in the shape of a cylinder instead of a flat plate, the difference in level is equal to a difference between a distance from an arbitrary point on one of the average lines to the axis of the cylinder and a distance from an arbitrary point on the other average line to the axis.

The difference in surface level between the marking area 4 and the non-marking area, the appearance of the photoconductive layer 3 and the image quality obtained through the copying process were analyzed by varying the grinding amount and etching amount when the marking area 4 was processed. The results are shown in Table 1.

[TABLE 1]

| | | Difference in Surface Level (μm) | | | | |
|---|---|---|---|---|---|---|
| | | 0.5 | 1.0 | 2.0 | 2.5 | 3.0 |
| image | blank | ○ | ○ | ○ | x | x |
| | black dots | ○ | ○ | ○ | ○ | x |
| appearance | | ○ | Δ | Δ | x | x |

As is clear from Table 1, when the difference in surface level exceeds 3 μm, imperfect images including blank or black dots are produced. When the difference does not exceed 2 μm, images do not have such faults and practically there is no problem. Furthermore, when the difference is not greater than 0.5 μm, the photoconductive layer 3 has a favorable appearance.

Meanwhile, an angle between the surface of non-marking area and the surface of the marking area 4 that meet each other may produce a white stripe in the half-tone image. The profiles of the vertical sections of the non-marking area and the marking area 4 cut across the border line therebetween were analyzed in the vicinity of the border line as illustrated in FIG. 1(*b*).

By definition, the above-mentioned average line is a line representing a minimum sum of squares of the deviation of the profile curve of the vertical section. The profile curve represents the actual vertical height level of the surface of the photoconductive layer 3. For example, a profile curve $M_2$ of the non-marking area and a profile curve $N_2$ of the marking area 4 in the vicinity of the borderline in FIG. 1(*b*). Additionally, by definition, average line $M_0$ of the non-marking area near the border with the marking area 4 crosses average line $N_0$ of the marking area 4 at point P, a tangent line of the average line $M_0$ passing through the intersection P and a tangent line of the average line $N_0$ passing through the intersection P are $M_1$ and $N_1$, respectively, and the acute angle between the tangent lines $M_1$ and $N_1$ is $\theta$.

The profiles of the vertical sections of the non-marking area and the marking area 4 cut across the border line were varied. The various configurations of the vertical sections and the image quality of copies produced by the copying process were repeatedly analyzed. It was observed that the border appeared as a distinct white line in the half-tone image when $\theta$ exceeded 30° and that no white line or an unobtrusive white line appeared when $\theta$ was in the range of $0° \leqq \theta \leqq 30°$.

Therefore, in the event of producing the marking area 4 in the surface of the substrate 2, in order to manufacture the photoreceptor drum 1 having a uniform characteristic, it is important to make the surface level of the non-marking area and that of the marking area 4 even by controlling 8 within the range of $0° \leqq \theta \leqq 30°$. It is also desirable to control the difference in level between the average lines $M_0$ and $N_0$ to be within about 2 μm near the border line.

Four examples of a method of processing the marking area 4 which satisfy the above-mentioned requirements are described below. The members having the same function as in the above-mentioned embodiment will be designated by the same code and their description will be omitted. Here, $\theta$ and the difference in surface level between the non-marking area and the marking area 4 were measured with a surface roughness tester.

EXAMPLE 1

Figure 2:
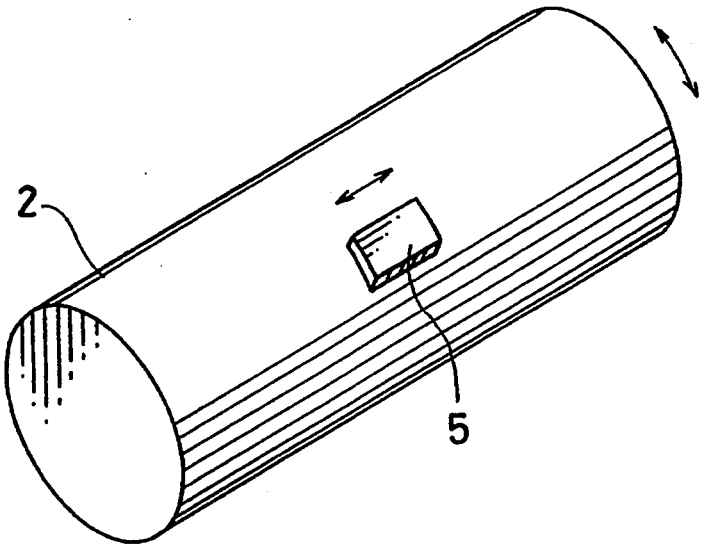
FIG. 2 is an explanatory view illustrating in detail a method for forming the marking area in the electrically conductive substrate.

As illustrated in FIG. 2, in the first method, a portion of the surface of the electrically conductive substrate 2 is ground with a grinding stone 5. The grind stone 5 is produced by binding silicon carbide of mesh size #1000 as grinding grain with a resin series binding agent.

To produce the marking area 4, the grinding surface of the grinding stone 5 is pressed against the substrate 2 so that the grinding surface is evenly in contact with a portion of the surface of the substrate 2, and the grinding stone 5 is vibrated in the axis direction of the substrate 2. Simultaneously the substrate 2 is slightly rotated clockwise and counterclockwise to vary the time in which the grinding stone 5 makes contact with an edge portion of the marking area 4 near the border with the non-marking area, i.e., a circumferential portion of the marking area 4. Consequently, the ground amount near the circumferential portion of the marking area 4 is varied and the vertical section of the marking area 4 near the border line is tilted at an angle within the range of $0° \leqq \theta \leqq 30°$.

The marking area 4 produced in this example has a surface roughness $R_{max}$ of 3 μm, and a partial or average difference in surface level between the marking area 4 and the non-marking area is not greater than 2 μm.

EXAMPLE 2

Figure 3:
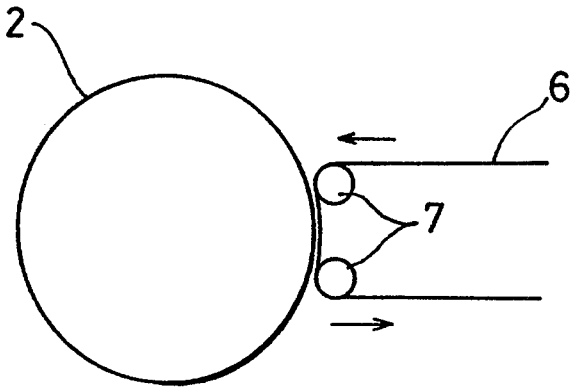
FIG. 3 is an explanatory view illustrating in detail another method for forming the marking area in the electrically conductive substrate.

As illustrated in FIG. 3, in the second method, a portion of the surface of the electrically conductive substrate 2 is ground with a grinding tape 6. The grind tape 6 is produced by depositing on a polyester film silicon carbide of mesh size #1000 as grinding grain and a resin series binding agent.

To produce the marking area 4, the grinding tape 6 is carried by tension rollers 7 located above and below the grinding tape 6 so that the grinding surface of the grinding tape 6 is evenly in contact with a portion of the surface of the substrate 2. Then, the grinding tape 6 is slightly vibrated in the axis direction of the substrate 2 while holding the substrate 2 in a position. Simultaneously the grinding tape 6 is fed as shown by the arrows in FIG. 3.

The time during which the grinding tape 6 makes contact with an edge portion of the marking area 4 near the border with the non-marking area, i.e., a circumferential portion of the marking area 4 is varied by slightly vibrating the grinding tape 6 in the axis direction of the substrate 2. Consequently, the ground amount near the circumferential portion of the marking area 4 is varied and the vertical section of the marking area 4 near the border line is tilted at an angle within the range of $0° \leqq \theta \leqq 30°$.

The marking area 4 produced in this example has a surface roughness $R_{max}$ of 3 μm, and a partial or average difference in surface level between the marking area 4 and the non-marking area is not greater than 2 μm.

EXAMPLE 3

Figure 4:
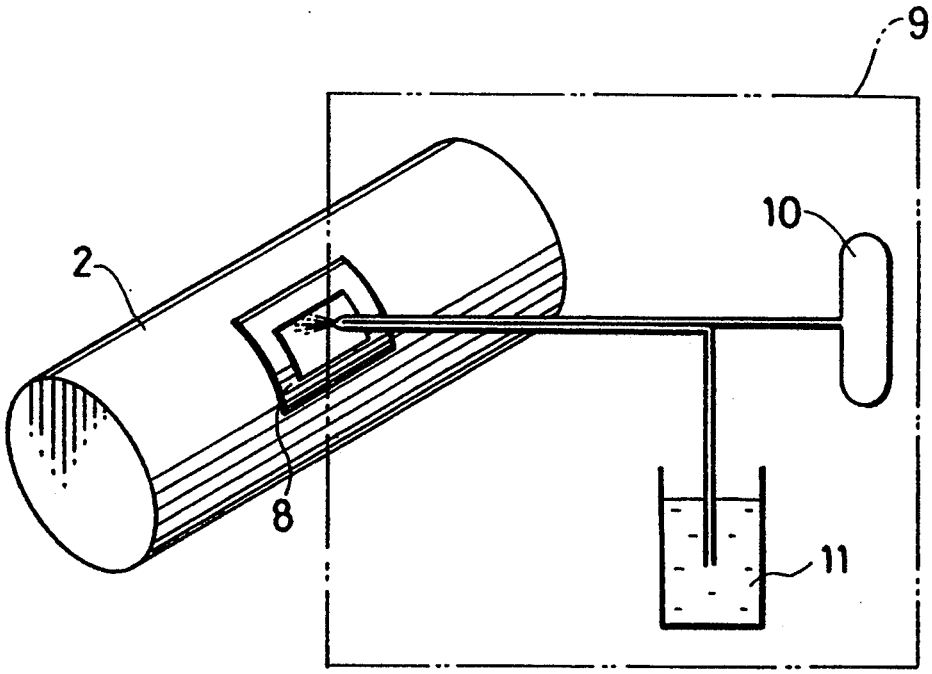
FIG. 4 is an explanatory view illustrating in detail still another method for forming the marking area in the electrically conductive substrate.

As illustrated in FIG. 4, in the third method, a portion of the surface of the electrically conductive substrate 2 is ground by spraying a water solution 11 containing a grinding material on the portion under high pressure. More specifically, the water solution 11 contains silicon carbide of mesh size #1000 as grinding grain.

The marking area 4 was produced with a liquid honing machine 9. Compressed air 10 was used to spray the water solution 11 on the portion of the surface of the substrate 2 through a nozzle. In spraying, areas of the substrate where the marking area 4 was not to be formed was covered with a protecting mask 8. The pressure of the sprayed water solution 11 decreases outward from the center. Since the circumferential portion of an area on which the water solution 11 is sprayed always comes inside the marking area 4 to be formed, the vertical section of the marking area 4 near the border line is tilted at an angle within the range of $0° \leqq \theta \leqq 30°$.

In this embodiment, a portion of the surface of the substrate 2 is arranged to have a matt finish or a relatively rough surface so as to produce the marking area 4 having a surface roughness $R_{max}$ of 3 μm, and a partial or average difference in surface level between the marking area 4 and the non-marking area which is not greater than 2 μm.

The three processing methods using grinding grains have been mentioned here. However, it is also possible to adapt lapping and buffing into the process.

EXAMPLE 4

Figure 5:
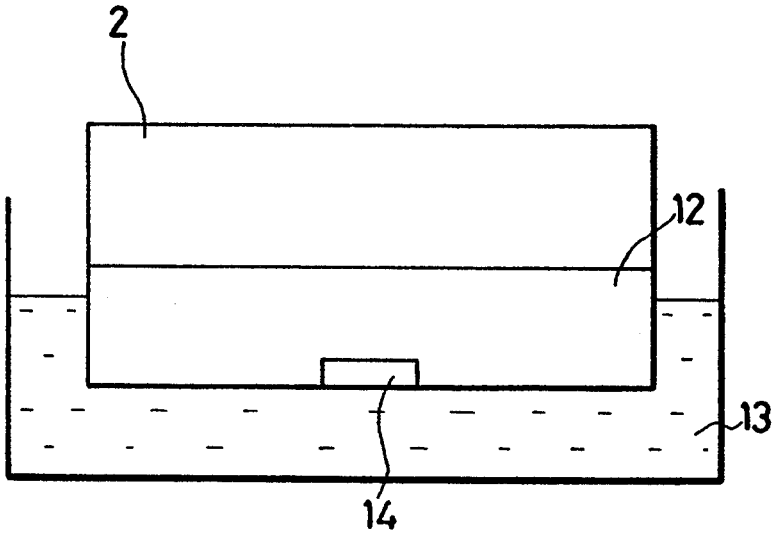
FIG. 5 is an explanatory view illustrating in detail still another method for forming the marking area in the electrically conductive substrate.

As illustrated in FIG. 5, in the fourth method, a portion of the surface of the electrically conductive substrate 2 is made rougher by chemically etching the portion.

To produce the marking area 4 having a reflectance which is different from that of the non-marking area, a film 12 was formed by applying a masking agent to the surface of the substrate 2 and a window-like area 14 was created in a portion of the film so as to allow selective etching. At the border between the film 12 and area 14, the amount of the masking agent was adjusted so that the thickness of the film 12 consecutively increases outward from border with the area 14.

The substrate 2 thus obtained was dipped for about one minute into an etchant 13 formed by a water solution containing 5% potassium hydroxide (KOH). Then, the substrate 2 was cleaned with demineralized water and the film 12 was removed.

Thus, the marking area 4 produced on the surface of the substrate 2 has in the vicinity of the border line a vertical section which is tilted at an angle within the range of $0° \leqq \theta \leqq 30°$, a surface roughness $R_{max}$ of 3 μm, and a partial or average difference in surface level between the marking area 4 and the non-marking area is not greater than 2 μm.

After cleaning the substrate 2 having the marking area 4 in the above-mentioned manner, a 60 μm photoconductive film was formed by vacuum-depositing $A_{s2}$-$S_{e3}$ as a photoconductive material on the substrate 2 to complete the photoreceptor drum 1.

Figure 6:
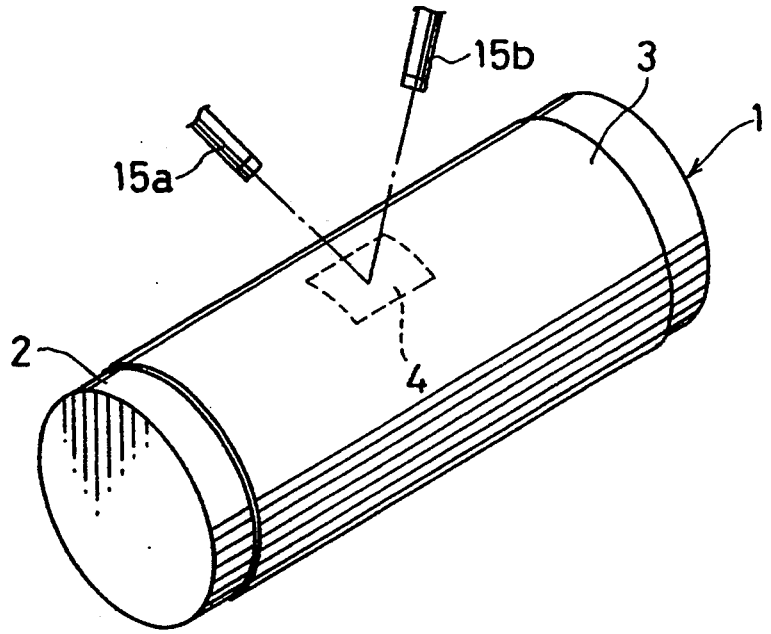
FIG. 6 is an explanatory view illustrating a method for measuring the optical reflection property of the marking area.

As illustrated in FIG. 6, the optical reflection property of the marking area 4 was evaluated using the photocoupler composed of the light emitting section 15*a* and the light receiving section 15*b*, mounted in the copying machine. More specifically, light was emitted by the light emitting section 15*a* while rotating the photoreceptor drum 1 at a predetermined speed, and the output of the light receiving section 15*b* was monitored. As for the light emitting section 15*a*, for instance, an element for projecting light which can pass through the photoconductive layer 3 like infrared light was used.

Figure 7:
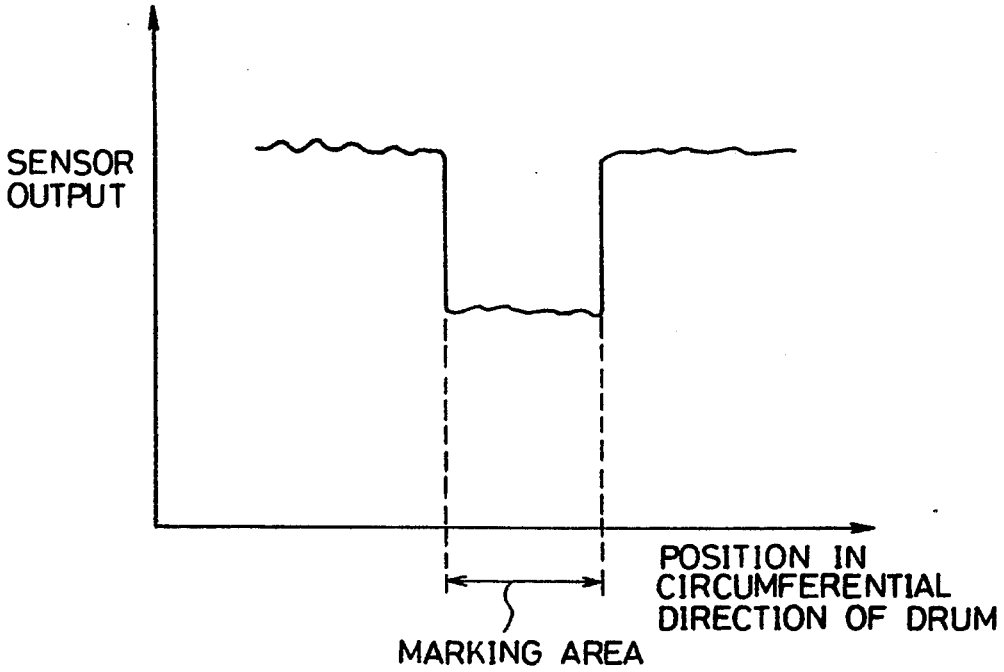
FIG. 7 is an explanatory view illustrating the waveform of a detection signal with respect to the marking area obtained according to the method of FIG. 6.

The results are shown in FIG. 7. As is clear from FIG. 7, since light is irregularly reflected from the marking area 4, the reflectance at the marking area 4 decreases. The waveform of an output of the light receiving section 15*b* corresponding to a location in a circumferential direction of the photoreceptor drum 1 shows that the output is lowered at the marking area 4. Namely, it has been confirmed that a signal which properly indicates a reference location on the photoreceptor drum 1 is obtained from the marking area 4.

As described above, with the photoreceptor for the electrophotography of the present invention, it is possible to form a photoconductive layer having a uniform characteristic on an electrically conductive substrate even when a second surface having uneven optical reflection property is formed in a first surface of the substrate. This prevents the border between the first and the second surfaces from affecting the image quality of copies. In addition, since information for optimizing the image quality of copies is obtained from the same location on the photoreceptor by using the second surface as a reference location, copies of stabilized image quality are always obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A photoreceptor for electrophotography comprising:

an electrically conductive substrate including a first surface having a first optical reflection property and a second surface having a second optical reflection property which differs from the first optical reflection property, said second surface being formed in a portion of said first surface; and a photoconductive layer formed on said electrically conductive substrate, wherein an acute angle $\theta$ between a tangent line $M_1$ and a tangent line $N_1$ is within a range of $0° \leqq \theta \leqq 30°$, the tangent line $M_1$ touching an average line $M_0$ at an intersection P of the average line $M_0$ and an average line $N_0$, the tangent line $N_1$ touching the average line $N_0$ at intersection P, the average line $M_0$ being an average line of a first profile curve of said first surface, the average line $N_0$ being an average line of a second profile curve of said second surface, the first profile curve and the second profile curve being obtained by vertically cutting said first and second surfaces along a perpendicular line to a border line between said first and second surfaces at an arbitrary point on the border.

2. The photoreceptor for electrophotography according to claim 1, wherein a difference in levels between two arbitrary points on the average lines $M_0$ and $N_0$ is not greater than 2 $\mu$m.

3. The photoreceptor for electrophotography according to claim 1, wherein a difference in levels between two arbitrary points on the average lines $M_0$ and $N_0$ is not greater than 0.5 $\mu$m.

4. The photoreceptor for electrophotography according to claim 1, wherein said second surface is processed so as to be rougher than said first surface.

5. The photoreceptor for electrophotography according to claim 1, wherein said second surface is mechanically processed so as to be rougher than said first surface.

6. The photoreceptor for electrophotography according to claim 1, wherein said second surface is chemically processed so as to be rougher than said first surface.

7. The photoreceptor for electrophotography according to claim 1, wherein said electrically conductive substrate is cylindrical in shape, and a difference between a distance from an arbitrary point on the average line $M_0$ to an axis of said cylinder and a distance from an arbitrary point on the average line $N_0$ to said axis is not greater than 2 $\mu$m.

8. The photoreceptor for electrophotography according to claim 5, wherein said second surface is formed by grinding a portion of said first surface.

9. The photoreceptor for electrophotography according to claim 5, wherein said second surface is formed by spraying a liquid containing a grinding material on a portion of said first surface under high pressure.

10. The photoreceptor for electrophotography according to claim 6, wherein said second surface is formed by selectively etching a portion of said first surface.

* * * * *